US006209158B1

(12) United States Patent
Cox et al.

(10) Patent No.: US 6,209,158 B1
(45) Date of Patent: Apr. 3, 2001

(54) INVALID BED

(76) Inventors: Robert Cox; Juanice Cox, both of 10281 Triple Crown Ave., Jacksonville, FL (US) 32257

( * ) Notice: Subject to any disclaimer, the term of this patent is extended or adjusted under 35 U.S.C. 154(b) by 0 days.

(21) Appl. No.: 09/390,764

(22) Filed: Sep. 7, 1999

(51) Int. Cl.[7] ..... A47C 20/00
(52) U.S. Cl. ..... 5/648; 5/651; 5/662; 5/507.1
(58) Field of Search ..... 5/648, 651, 662, 5/624, 507.1

(56) References Cited

U.S. PATENT DOCUMENTS

| | | | | |
|---|---|---|---|---|
| 1,330,373 | | 2/1920 | Hall . | |
| 2,640,205 | * | 6/1953 | Simpson | 5/651 |
| 3,173,157 | * | 3/1965 | Maples | 5/651 |
| 3,743,051 | | 7/1973 | Cramer | 182/15 |
| 3,826,336 | | 7/1974 | Cramer | 182/15 |
| 3,841,437 | | 10/1974 | Caughey | 182/16 |
| 3,884,327 | | 5/1975 | Zigman | 182/113 |
| 3,995,846 | * | 12/1976 | Frick | 5/648 |
| 4,113,161 | | 9/1978 | Manuszak | 224/46 R |
| 4,980,938 | * | 1/1991 | Bivins | 5/648 |

FOREIGN PATENT DOCUMENTS

| | | | | |
|---|---|---|---|---|
| 19041 | * | 7/1909 | (GB) | 5/651 |
| 103438 | * | 1/1917 | (GB) | 5/651 |

* cited by examiner

*Primary Examiner*—Michael F. Trettel
(74) *Attorney, Agent, or Firm*—Henderson & Sturm LLP

(57) ABSTRACT

An improved invalid bed for use by individuals that are unable to lift themselves into a seated position with their arms that includes a foot board and a foot support spacer that is positionable against the foot board of the bed and against which the user can push with their feet to slide themselves into a seated position.

6 Claims, 2 Drawing Sheets

INVALID BED

BACKGROUND OF THE INVENTION

1. Field of the Invention

The present invention relates to the field of beds for the infirm, and more particularly to an invalid bed having a foot support spacer.

2. Description of Related Art

As can be seen by reference to the following U.S. Pat. Nos. 1,330,373; 3,743,051; 3,826,336; 3,841,437; 3,884,327; and 4,113,161, the prior art is replete with myriad and diverse foot support devices for the infirm.

While all of the aforementioned prior art constructions are more than adequate for the basic purpose and function for which they have been specifically designed, they are uniformly deficient with respect to their failure to provide a simple, efficient, and practical invalid bed having a foot support spacer.

As a consequence of the foregoing situation, there has existed a longstanding need for a new and improved type of invalid bed, and the provision of such a construction is a stated objective of the present invention.

BRIEF SUMMARY OF THE INVENTION

Briefly stated, the present invention provides an improved invalid bed for use by individuals that are unable to lift themselves into a seated position with their arms that includes a foot board and a foot support spacer that is positionable against the foot board of the bed and against which the user can push with their feet to slide themselves into a seated position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
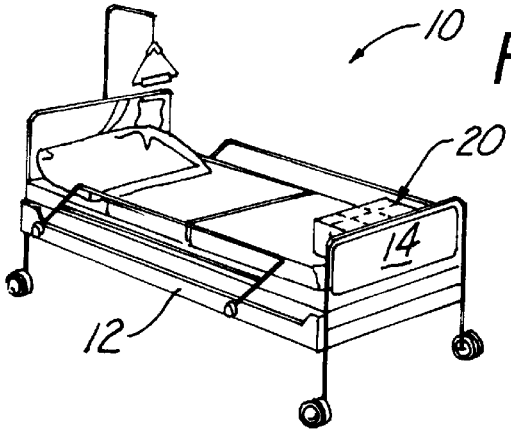
FIG. 1 is a perspective view of the invalid bed with the foot support spacer positioned at the foot board of a bed.
Figure 2:
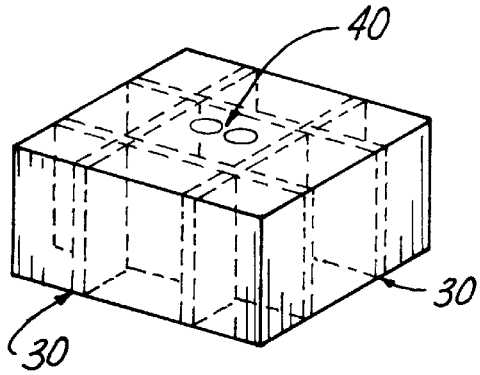
FIG. 2 is a perspective view of the foot support spacer.
Figure 3:
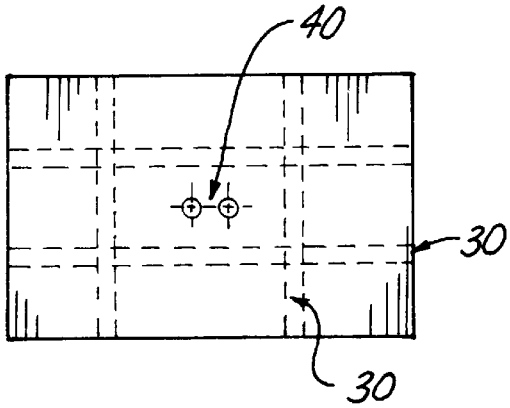
FIG. 3 is a top plan view thereof.
Figure 4:
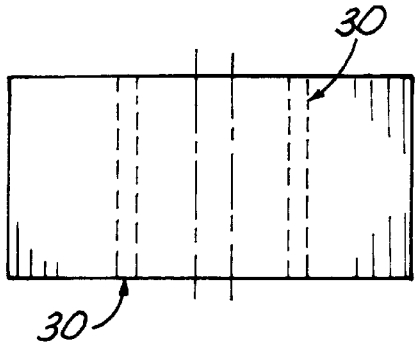
FIG. 4 is a front elevational view thereof.

As can be seen by reference to the drawings, and in particular to FIG. 1, the invalid bed that forms the basis of the present invention is designated generally by the reference number 10. The invalid bed 10 includes a frame 12 and an attached foot board 14. A foot support spacer 20 is selectively positioned next to the foot board 14. The spacer

20 is a small plastic or hard rubber enclosure approximately 12 inches long, 8 inches wide, and 6 inches high, weighing 2–3 pounds. The rectangular shape allows for the different heights of patients, as it could be turned to a selected side when in use. Four internal ribs or dividers 30, with two running lengthwise, and two running from side to side, strengthen the enclosure allowing it to be used as both a step stool and as a push off spacer between the feet of the patient and the foot board. Two access holes 40 in the top allow the device to be easily picked up and moved.

The spacer 20 provides a person confined to a hospital bed with a means of pushing themselves up when desired, by merely placing their feet against the spacer 20 and using it to push to with their feet. Access holes 40 in the top of the spacer 20 enable anyone to easily pick up the device when desired.

Figure 5:
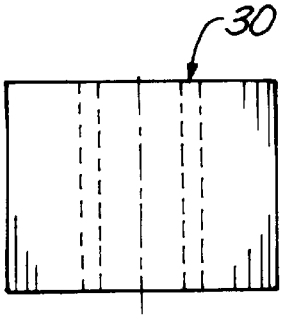
FIG. 5 is a side elevational view thereof.
Figure 6:
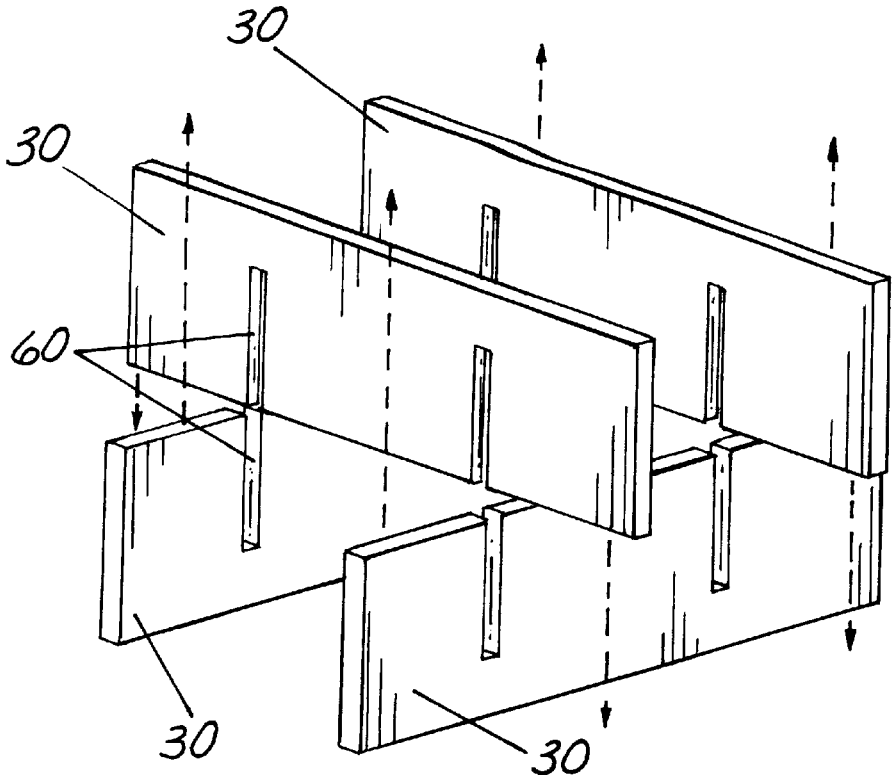
FIG. 6 is an exploded perspective view of the internal reinforcing panels.
Figure 7:
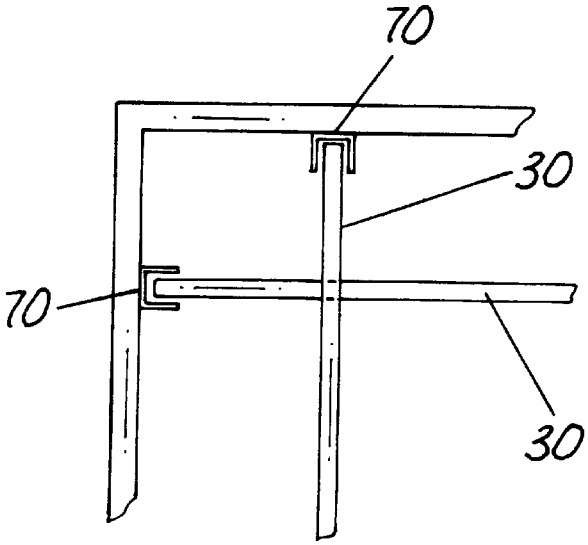
FIG. 7 is a partial top plan view of the reinforcing panels received in U-shaped channels.

FIG. 5 shows the internal interconnection of the reinforcing panels 30 located on the inside of the spacer 20. As seen in the illustration, there are intersecting panels 30 that allow mating slots 60 to interconnect in a fashion that provides a strengthened box-type bracing . FIG. 6 illustrates a top view of the panels 30 and their connection to the inside of the spacer 20, utilizing vertical U-type connectors 70 which form a female attachment component for the reinforcement panels 50. This type of attachment method allows all of the reinforcement panels 30 to be fabricated separately, reducing the cost of tooling necessary for manufacture. The reinforcement panels 30 may be designed to fit together very tightly at the factory level, or may snap together for installation by the end user. Components of the spacer 20 may be formed from glass-filled ABS plastic or polyethylene plastic.

In use, the user would simply place the spacer 20 at the foot board 14 of the bed. They would then enjoy the benefit of being able to push themselves up in the bed at anytime desired by placing their feet against the spacer 20 and shoving. In addition, the spacer 20 could be used as a step stool to aide in getting in and out of bed. Use of the spacer 20 would provide a very practical, inexpensive, and easy to use method of allowing anyone who may not have sufficient upper body strength to push themselves up in bed.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. An invalid bed comprising:

a frame;

a foot board attached to the frame;

a selectively positioned foot support spacer including three pairs of opposing walls, each of the three pairs of walls having dimensions differing from the other pairs of walls, the spacer being selectively positioned such that one of a selected pair of the walls is positioned adjacent to and contacts the foot board; whereby a user's feet contact the opposing wall of the selected pair to assist the user in pushing off from the spacer away from the foot board; and wherein one wall of a pair of walls includes two adjacent circular openings, whereby the spacer may be gripped to reposition it at the foot board.

2. The invalid bed of claim 1 wherein the spacer may be positioned on a floor surface adjacent the bed to serve as a step to assist the user in moving to and from the bed.

3. The invalid bed of claim 1 wherein the spacer includes an internal reinforcing member.

4. The invalid bed of claim 3 wherein the reinforcing member includes intersecting panels disposed to extend between the three pairs of opposing walls.

5. The invalid bed of claim 4 wherein the intersecting panels include registerable slots disposed at predetermined intersection points.

6. The invalid bed of claim 5 wherein opposing ends of each panel are received in U-shaped channels attached to an interior surface of the walls.

* * * * *